US008573872B2

(12) United States Patent
Piazzai et al.

(10) Patent No.: US 8,573,872 B2
(45) Date of Patent: Nov. 5, 2013

(54) TERMINAL UNIT CONSISTING OF SIDE BY SIDE ARRANGED BASE UNIT AND PRINTER

(75) Inventors: Luciano Piazzai, Ivrea (TO) (IT); Gianrico Scarton, Ivrea (TO) (IT)

(73) Assignee: Telecom Italia S.p.A., Milan (IT)

( * ) Notice: Subject to any disclaimer, the term of this patent is extended or adjusted under 35 U.S.C. 154(b) by 699 days.

(21) Appl. No.: 11/793,721

(22) PCT Filed: Dec. 21, 2004

(86) PCT No.: PCT/IT2004/000711
§ 371 (c)(1),
(2), (4) Date: Jun. 21, 2007

(87) PCT Pub. No.: WO2006/067811
PCT Pub. Date: Jun. 29, 2006

(65) Prior Publication Data

US 2008/0038040 A1 Feb. 14, 2008

(51) Int. Cl.
*B41J 29/00* (2006.01)

(52) U.S. Cl.
USPC ..... 400/693; 400/719; 361/679.02

(58) Field of Classification Search
USPC ..... 400/693, 719; 235/383, 7 R; D14/422; 358/1.6; 361/679.02
See application file for complete search history.

(56) References Cited

U.S. PATENT DOCUMENTS 5,182,697 A 1/1993 I-Shou
5,507,491 A * 4/1996 Gatto et al. ..... 273/139
5,941,618 A * 8/1999 Cheng ..... 312/223.2
5,988,898 A 11/1999 Ackley et al.
6,011,850 A * 1/2000 Bertrand et al. ..... 380/59

(Continued)

FOREIGN PATENT DOCUMENTS

EP 677311 A2 * 10/1995
JP 63142963 A * 6/1988

(Continued)

OTHER PUBLICATIONS

International Search Report, Dated Sep. 14, 2005, Issued in Appln. PCT/IT2004/000711.

*Primary Examiner* — Daniel J Colilla
(74) *Attorney, Agent, or Firm* — Venable LLP; Robert Kinberg; Steven J. Schwarz

(57) ABSTRACT

A terminal unit comprising a base unit, in turn including a main body and a scanning device located in front of the main body, and a printing unit, distinct from the base unit, in which the scanning device has a width greater than that of the main body so that it has a lateral portion protruding from the latter, and also in which the base unit has a seat, defined by one edge of the main body and by the protruding portion of the scanning device, so as to removably accommodate the printing unit beside the base unit and behind the scanning device. The terminal unit, in the configuration with base unit and printer side by side, presents a clearance in the transverse direction that is significantly lower than the sum of the transverse clearances of the scanning device and of the printer, and in particular is within preestablished limits, so that the terminal unit can be used to advantage to replace existing terminals quickly and easily.

9 Claims, 5 Drawing Sheets

(56) References Cited

U.S. PATENT DOCUMENTS

| | | | | |
|---|---|---|---|---|
| 6,710,895 | B1 * | 3/2004 | Gatto et al. | 358/1.6 |
| 6,883,987 | B2 * | 4/2005 | Kamin et al. | 400/605 |
| 7,191,948 | B1 * | 3/2007 | Baitz et al. | 235/462.43 |
| 2004/0105126 | A1 * | 6/2004 | Minowa et al. | 358/1.18 |
| 2005/0099361 | A1 * | 5/2005 | Majer | 345/1.3 |
| 2005/0156024 | A1 * | 7/2005 | Ichikawa et al. | 235/379 |
| 2006/0059108 | A1 * | 3/2006 | Ash | 705/64 |
| 2006/0121981 | A1 * | 6/2006 | Pfennighausen et al. | 463/25 |
| 2006/0183554 | A1 * | 8/2006 | Piazzai et al. | 463/46 |

FOREIGN PATENT DOCUMENTS

| | | | | |
|---|---|---|---|---|
| JP | 08305955 | A | * | 11/1996 |
| JP | 09251497 | A | * | 9/1997 |
| JP | 10011172 | A | * | 1/1998 |
| JP | 10134248 | A | * | 5/1998 |
| JP | 11232345 | A | * | 8/1999 |
| JP | 2000076553 | A | * | 3/2000 |
| JP | 2001134838 | A | * | 5/2001 |
| JP | 2001222764 | A | * | 8/2001 |
| WO | WO 2004/081704 | A | | 9/2004 |

* cited by examiner

TERMINAL UNIT CONSISTING OF SIDE BY SIDE ARRANGED BASE UNIT AND PRINTER

FIELD OF THE INVENTION

This invention relates in general to a terminal consisting of a basic unit and a printer, reciprocally arrangeable side by side, particularly though not exclusively suitable for application in the sector of distributed systems for the management of telematic games, and/or similar activities.

BACKGROUND OF THE INVENTION AND STATE OF THE KNOWN ART

Terminal units are known, particularly for applications in the field of telematic games, provided with a scanning device, also called simply scanner, and a display screen, respectively for acquiring and displaying data.

One of these terminal units is for instance known from the international patent application published under number WO2004/081704 A2, by the same Applicant.

The scanner is preferably arranged on a front side of the terminal unit for receiving a document to be read, such as for instance a gaming coupon, whereas the display screen is in turn mounted on an upper portion of the terminal unit for displaying information concerning the transaction carried out, in particular the gaming data that have been read from the coupon by way of the scanner.

Still in the field of telematic games, the terminal unit may integrate in its structure a printer, for instance for printing the gaming data on a receipt, showing the wager made, which is issued to the player.

Where the terminal unit does not include a printer in its structure, it can be associated with a separate, single printer, in order to form with the latter a group capable of providing substantially the same functions as a terminal unit integrating a printer inside.

The known solutions at the moment do not appear capable of solving the problem of producing, at low cost, a terminal unit, associated with or provided with a printer, which is not just easy to maintain, but which also has an all-out clearance in the transverse direction, printer included, that is sufficiently low and coming within preestablished limits.

In particular, where the printer is integrated in the terminal unit, the latter's overall structure assumes greater complexity, precisely on account of accommodating and appropriately supporting the printer, with respect to the case in which the printer is absent and is not integrated, with a resulting rise in the costs of manufacturing the terminal unit.

On the other hand, where the printer is separate from the terminal unit and accordingly printer and terminal unit constitute two distinct units, all-out clearance transversally of the group comprised by these two side by side units tends to assume a rather high value and often no longer compatible with certain applications in which such a group comprising the terminal unit and the printer is to be used.

The U.S. Pat. No. 5,182,697 proposes a main computer provided on the outside with a seat, of elongated shape, extending in the longitudinal direction between a respective first side, open to the outside, and a respective second side, facing the first, closed and delimited by a wall.

The seat is also delimited by another two sides, oriented longitudinally and also facing one another, which are associated with two respective parallel guides, each configured as a rail, in turn suitable for slidingly accommodating, through the first open side of the seat, two corresponding grooves made in the outer casing of a printer intended to be mounted removably in this seat.

This solution has the drawback of considerably complicating, due to the presence and somewhat complex shape of this seat and of the corresponding two guide rails for removably accommodating the printer, the structure of the base unit consisting of the main computer, with a resultant increase in the relative manufacturing costs, as well as implying quite a laborious assembly of the printer in the seat formed in the main computer.

SUMMARY OF THE INVENTION

In view of what is offered by the known art, the Applicant therefore set the objective of producing a new terminal unit, comprising a base unit associated with a data reader or scanner, and a printer suitable for cooperating with the base unit for printing data, having on the whole a structure characterized by a low transversal clearance that is within preestablished limits, so as to allow, for instance, easy and rapid substitution of an old, installed terminal unit by the new terminal unit.

At the same time, the Applicant also set the target of producing a new terminal unit, associated with a scanner and a printer, in particular for the gaming sector, which, as well as being of low dimensions and easy to substitute, was also of a type permitting easy and convenient maintenance operations, especially for the printer.

The Applicant noted that it was possible to configure the terminal unit with a base unit and a printer, arrangeable side by side and separable, so as to have the scanner located in a front part of the base unit of the terminal unit and protruding to the side, and to situate the printer in the space behind the scanner.

In greater detail, the Applicant noted that, while the main body of the base unit of the terminal unit can be suitably sized in order to limit clearance in the transverse direction, the scanner on the other hand has a fixed dimension, determined in particular by the dimensions of the sheet that has to be read or scanned, which, when added to that of the printer, also conditioned by the dimensions of the sheet to be printed, does not permit compliance with the desired clearances.

In this way, it was found that, by lowering the transversal dimension of the body of the base unit of the terminal unit and locating the scanner in a front position, protruding from a side with respect to the body of the base unit, the printer, not necessarily requiring front access, could be positioned beside the body of the base unit of the terminal unit, behind the scanner.

The terminal unit of this invention, comprising a base unit and a printer that are distinct from one another and arrangeable side by side, has, in particular:

a) a limited overall transversal dimension, in particular not exceeding 420 mm, with a printer of a type suitable for being fed from a paper ribbon roll, a scanner, integrated in the base unit, capable of reading A4 format sheets, and a 12" display, so that a new terminal unit with these characteristics can be used to substitute, extremely easily, an old terminal unit, already installed, having a width of 420 mm and over;

b) an ergonomic structure particularly suitable for gaming office applications, especially within a framework of gaming systems that imply use of terminals distributed all over the land for receiving wagers, such as to permit all the gaming operations to be carried out easily, quickly and securely;

c) the possibility of also using the printer by itself, without presence of the base unit.

This invention relates to a terminal unit that comprises: a base unit including a main body and a scanning device, and a printing unit, in which the scanning device has a width greater than the main body, is placed in front of and protrudes laterally with respect to the main body; and the base unit has, to the side of the main body and behind the scanning device, a seat for removably accommodating the printing unit.

Preferably, the scanning device is placed in line, along a side facing the respective protruding portion, with the main body and, more preferably, is positioned along the front side of the base unit, so as to have a substantially vertical read surface.

Preferably, the base unit is provided at the top with a display screen the centre line of which is substantially in alignment with that of the scanning device, and is preferably fulcrum-mounted on the base unit in a zone immediately above the scanning device.

Also preferably, the display screen and the scanning device are arranged at a distance from one another in the base unit, and in addition the base unit is configured in the zone between the display screen and the scanning unit in such a way as to define a recess, adjacent to the seat for accommodating the printing unit, which is intended for receiving the paper ribbon issued by the printing unit housed in the seat.

The terminal unit according to the invention, in the configuration assembled with the base unit and the printer arranged side by side, one against the other, assumes a transversal clearance less than the sum of the width of the scanning device and of the printer.

In a preferred embodiment, the scanning device is of a type suitable for receiving and reading A4 sheets; and more preferably, the main body and the printer have respectively a width of approx. 220 mm and approx. 200, so that the terminal unit, in the configuration assembled with the base unit and printer arranged side by side, one against the other, assumes a transverse clearance of approx. 420 mm.

Again the display screen is preferably 12" type.

In a second aspect, this invention relates to a base unit of a terminal unit, including a main body and a scanning device located to the front of the main body, in which the scanning device has a width greater than the main body, and has a protruding portion that protrudes to the side with respect to the main body; and in addition, the base unit has, to the side of the main body (17) and behind the protruding portion of the scanning device, a seat for removably accommodating a printing unit, of the terminal unit.

BRIEF DESCRIPTION OF THE DRAWINGS

These and other characteristics of the invention will appear more clearly from the following description of an embodiment, with reference to the figures in the accompanying drawings, in which.

DETAILED DESCRIPTION OF A PREFERRED EMBODIMENT OF THE INVENTION

Figure 1:
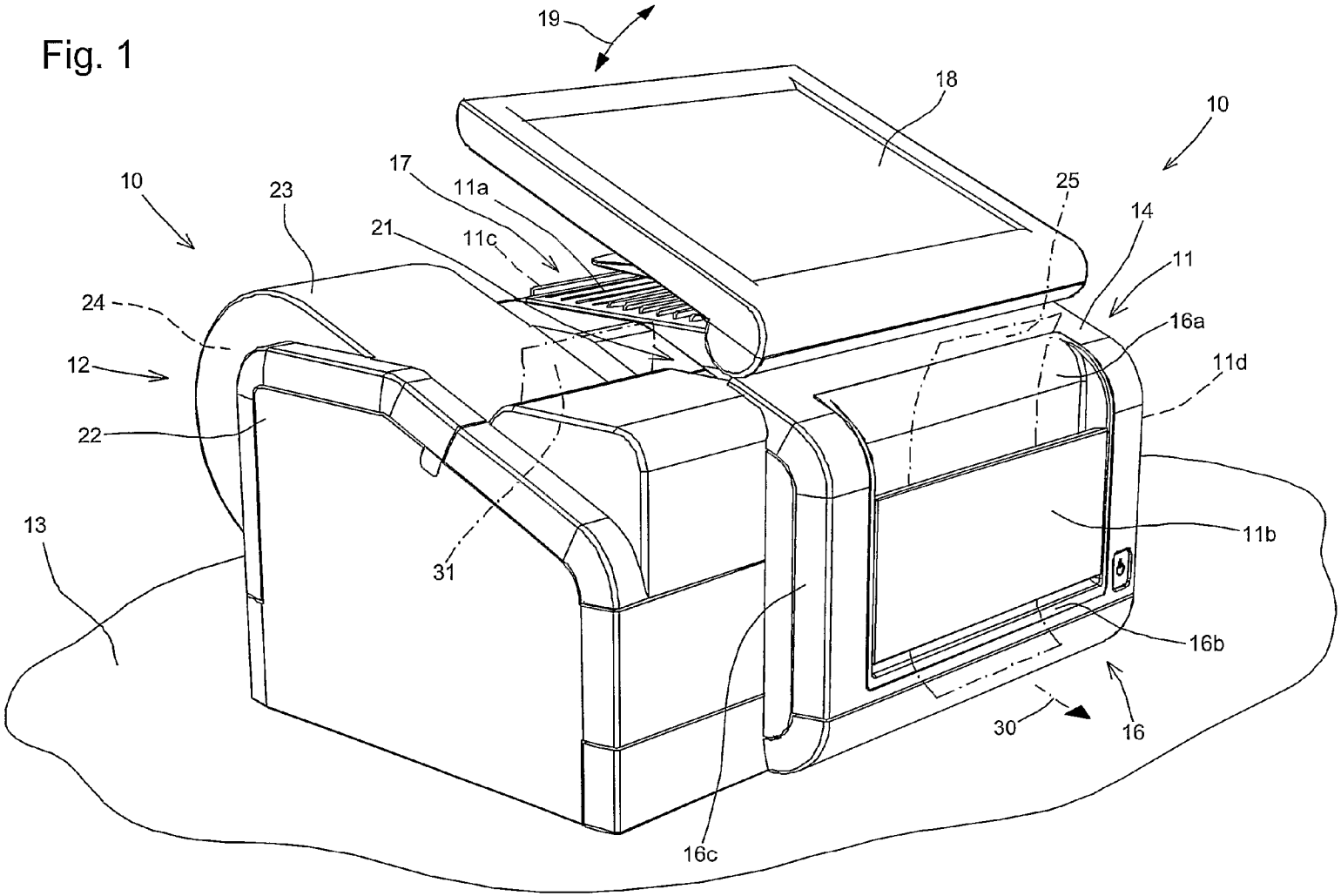
FIG. 1 is a first, front perspective view of a terminal unit, according to the present invention, consisting of a base unit and a printer, in a first configuration with the base unit and the printer arranged side by side, one against the other.
Figure 2:
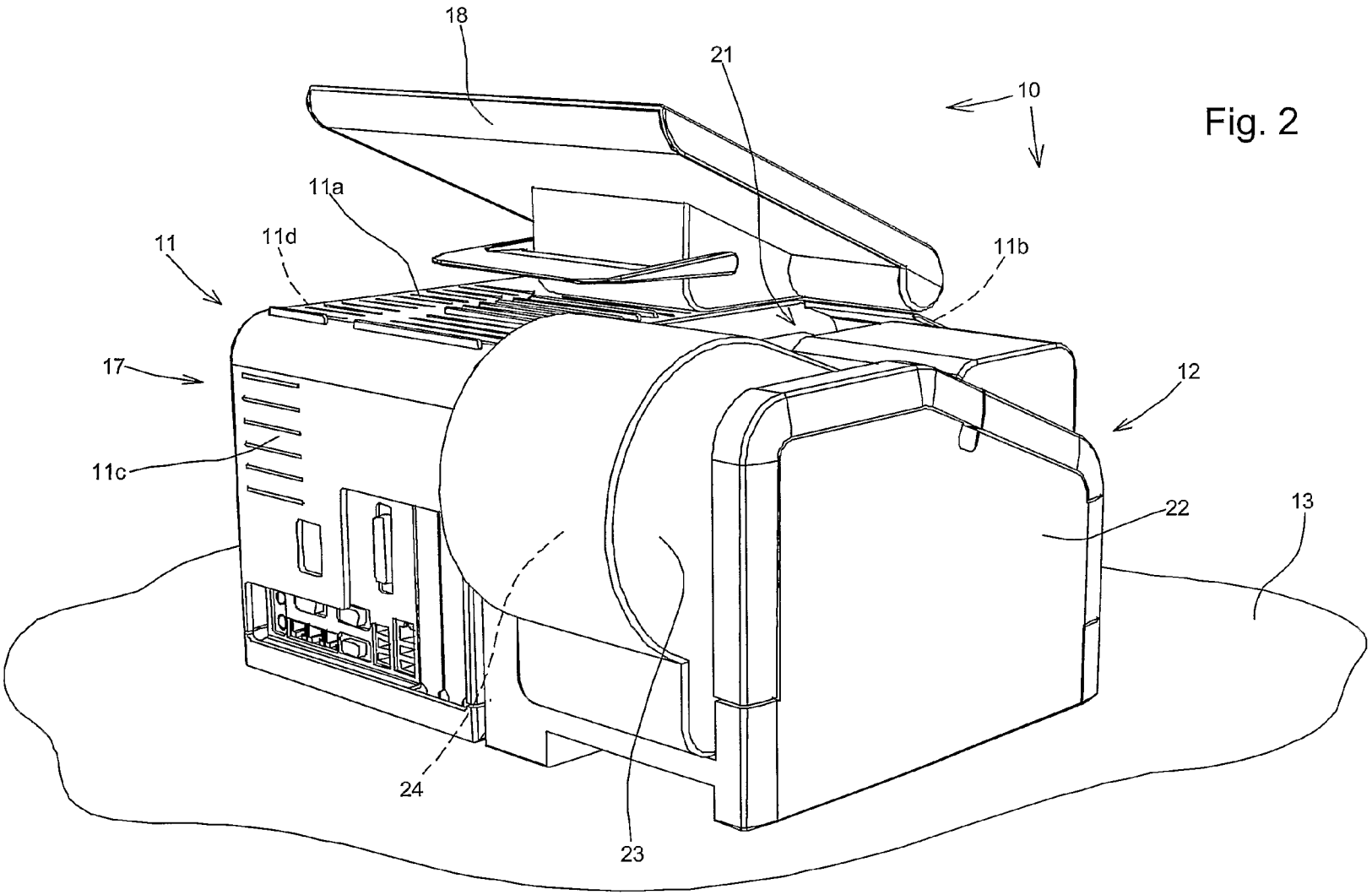
FIG. 2 is a rear perspective view of the terminal unit of FIG. 1.

With reference to FIGS. 1 and 2 a terminal unit, according to the present invention and indicated generically with the numeral 10, is composed of two main parts, that is a base unit, generically indicated with the numeral 11, and a printer, generically indicated with the numeral 12, which are arranged side by side and are both sitting on a common, horizontal support plane 13 of the terminal unit 10.

In its general use, the terminal unit 10 is normally intended for acquiring, processing, displaying and printing data, and for example can be part of a communications network, in which the terminal unit 10, like other similar terminals, can perform an interface function with the outside of the network, in particular in respect of the users of the network in question.

Alternatively, the terminal unit 10 can act as an autonomous operating unit.

As further explained below, the base unit 11 and the printer 12 constitute two parts which are easily put together, simply by placing them side by side, therefore without the need for implementing special connections between them, and which may need to be connected electrically with a lead, not shown in the drawings, to permit data to be exchanged between these two parts.

Figure 3:
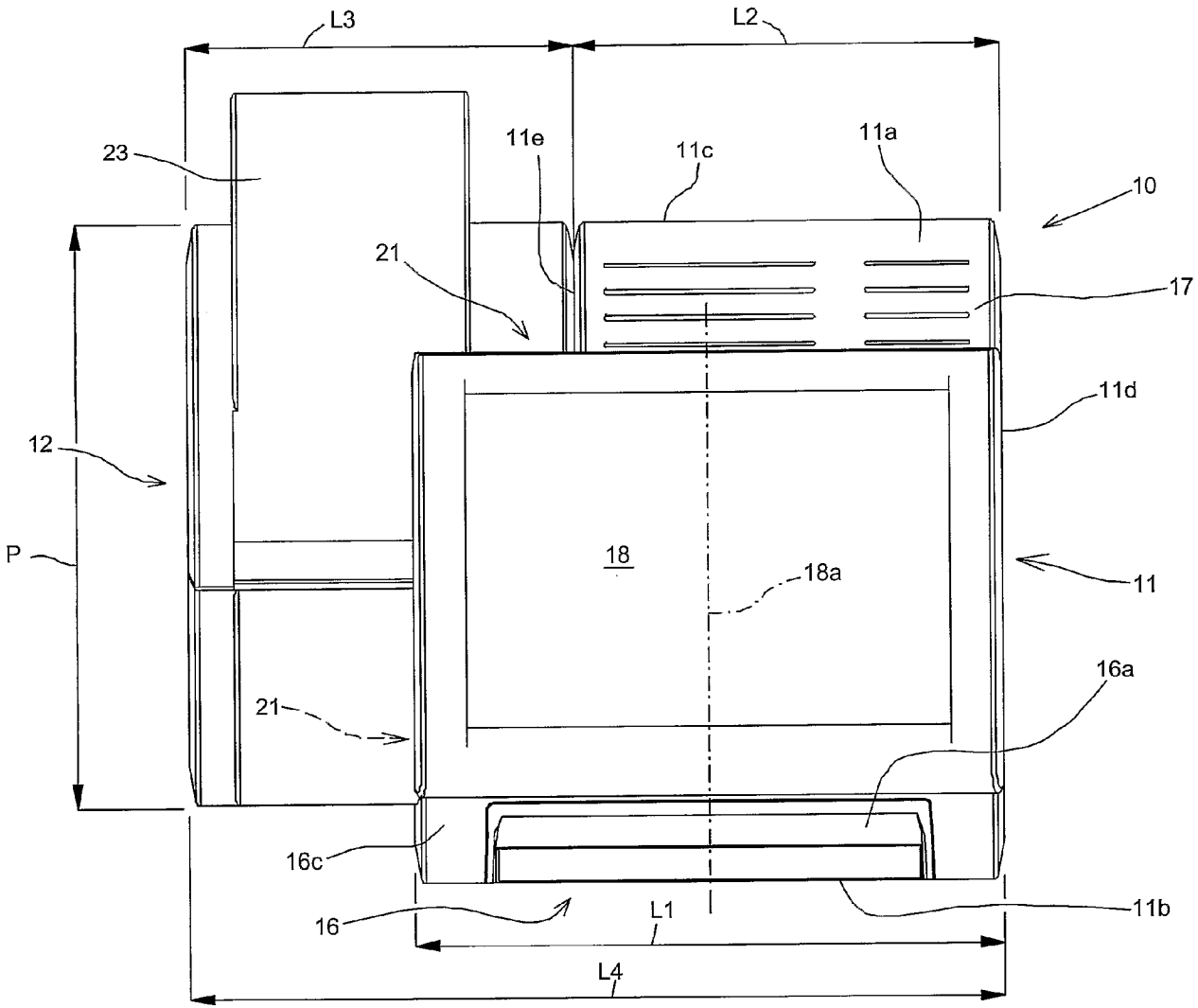
FIG. 3 is a plan view of the terminal unit of FIG. 1.

FIGS. 1-3 represent the terminal unit 10 in its typical or assembled configuration, with the base unit 11 and the printer 12 arranged side by side, one against the other and sitting on the plane 13.

Figure 4:
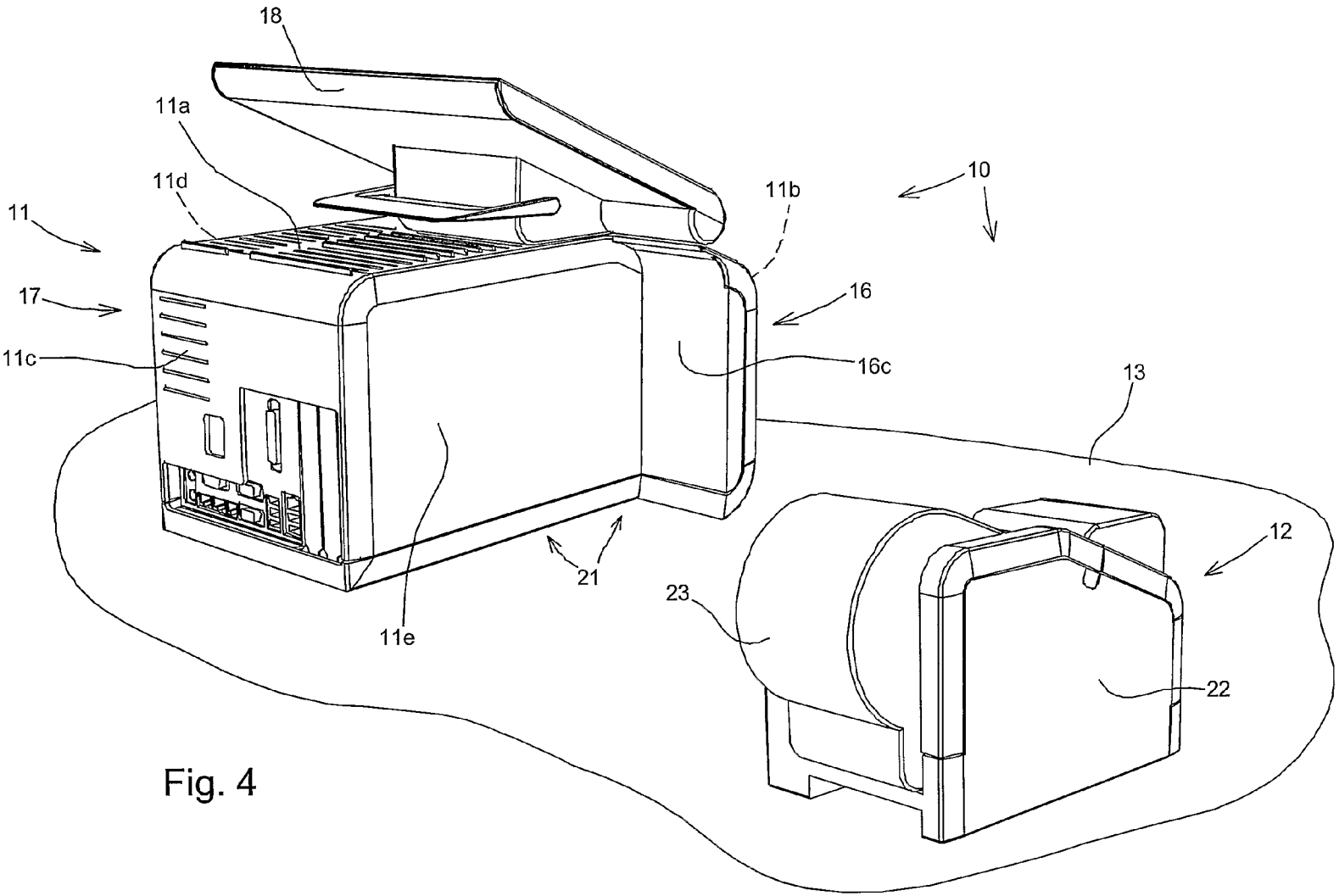
FIG. 4 is a perspective view of the terminal unit of FIG. 1, in a second configuration with the base unit and the printer located at a distance from one another.

The base unit 11 and the printer 12 may subsequently be separated from one another, as shown in FIG. 4, for instance to carry out routine maintenance work on one or the other of these two parts.

In short, in performing these simple operations, the terminal unit 10 can be easily broken down into the two parts that comprise it, i.e. the base unit 11 and the printer 12, and be subsequently put together again, by setting these parts side by side again, every time that this is necessary depending on the user's requirements.

With reference to FIG. 1 which shows the terminal unit 10 from the front, the base unit 11 has in its general form, defined by an external casing 14, an upper area 11*a*, a front side 11*b*, a rear side 11*c*, a right side 11*d* and a left side 11*e*.

More particularly, the base unit 11 comprises, on the respective front edge 11*b*, a scanning device 16, for scanning and reading documents, and behind it a main body 17, having a shape similar to that of a parallelepiped, the faces of which correspond to the upper area 11*a*, the rear side 11*c*, the right side 11*d* and the left side 11*e* of the base unit 11.

The scanning device 16, located in front of the main body 17, has a clearance, in the transverse direction, defined by a width L1, which is significantly greater than that, again in the transverse direction and defined by a width L2, of the main body 17 behind, which is parallelepiped shape.

As shown in FIG. 3, the scanning device 16 is located exactly aligned, along the right side, with the side 11*d* of the base unit 11, and in this way forms, in the area of the left side, a portion 16*c* which extends and protrudes from the left side 11*e*, defined by the main body 17 of the base unit 11.

The scanning device 16 is incorporated in the structure and outer case 14 of the base unit 11 and is associated with a corresponding entrance section 16*a* and a corresponding exit section 16*b*, which are provided respectively for receiving from the outside a document 25 to be read, represented by the dot and dash line in FIG. 1, and consisting, for instance, of a gaming coupon, and for handing back this document again to the outside, as indicated by an arrow 30, after reading has been performed thereof by the scanning device 16.

In this way, the terminal unit 10 is capable of acquiring data read from a document inserted from the outside in the base unit 11.

The scanning device 16 is of known characteristics and, for example, with regard to the size characteristics, may be of the type called A4, so as to be able to receive through the entrance section 16*a* a document to be read in formats up to A4 (214× 297 mm).

Indicatively, with reference to the indications on the plan view of FIG. 3, the width L1 of the scanning device 16 is approx. 300 mm, whereas the width L2 of the main body 17 is approx. 220 mm.

Accordingly, depending on these numerical values, the side portion 16*c* of the scanning device 16 is protruding with respect to the side 11*e*, which is of approx. 80 mm.

The main body 17 in turn contains inside the various control devices and units, associated with the scanning device 16 and the printer 12, which control operation of the base unit 11 and, in general, of the terminal unit 10.

Preferably, the base unit 11 also comprises a display screen 18, of known type, for instance a liquid crystal flat screen, or similar, which is fulcrum-mounted on the main body 17, in correspondence with the upper area 11*a* of the base unit 11, and immediately above the entrance section 16*a* of the scanning device 16.

In this way, the display screen 18 can be variably inclined with respect to the main body 17, as indicated by a double arrow 19, depending on the requirements of the operator located in front of the terminal unit 10.

The display screen 18 is arranged in such a way as to have the relative centre plane 18*a* substantially in line with that of the scanning device 16, as shown in FIG. 3, and in addition, preferably, has a width that is substantially identical to that, shown with L1, of the scanning device 16.

By way of example, the display screen 18, as regards its dimensions, may be of the 12" type, in which case, it has a width of approx 300 mm, which corresponds to that, already mentioned earlier for guidance, for a scanning device 16 conforming to A4 format.

The printer 12 too is of known type, and none of its internal manufacturing particulars will be described here, not being of relevance for this invention.

For instance the printer 12 may be of the type suitable for printing on paper ribbon 31, represented by the dot and dash line in FIG. 1, fed from a roll of paper 24 housed inside the printer 12, in order to issue to the outside a printed receipt bearing data relating to the operations that have been carried out by means of the terminal unit 10.

For this purpose, the printer 12, the external shape of which is defined by a case 22, may be provided with one or more doors 23 that may be opened to permit access to the inside of the printer 12, so as to perform on it the routine maintenance operations which are required during its operation, such as for example the replacement of a finished paper roll with a new paper roll or of the printing element.

The printer 12, if seen from the front as represented in FIG. 1, has a depth P, roughly equal to the main body 17 of the base unit 11, and a width L3, in the transverse direction, which is for example of 200 mm, consistent with the previous dimensions given for the base unit 11.

According to a characteristic of this invention, the base unit 11 has laterally a seat 21 suitable for receiving and housing the printer 12, when it is set side by side the base unit 11, in which this seat 21 is defined by the portion 16*c* of the scanning device 16 that protrudes laterally from the side 11*e*, defined by the main body 17, of the base unit 11, and by the side 11*e* itself.

Thanks to this configuration of the seat 21, the printer 12 can be housed, at least partially, behind the scanning device 16, in the configuration of the terminal unit 10 shown in FIGS. 1-3, with the base unit 11 and the printer 12 arranged one beside the other.

In use, the terminal unit 10 may be assembled in its built-up configuration, such as that depicted in FIGS. 1-3, starting from a broken-down configuration such as that represented in FIG. 4, simply by drawing the base unit 11 and the printer 16 closer to one another, until the latter is accommodated in the seat 21 defined by the base unit 11, directly against the wall 11*e* and immediately behind the protruding portion 16*c* of the scanning device 16.

In this way, the portion 16*c* in part overlaps on the front edge of the printer 12, so that the terminal unit 10 in its built-up configurations assumes an all-out transversal clearance, defined by a total width L4 (FIG. 3), which is substantially determined by the sum of the transversal clearances of the main body 17 and of the printer 12, i.e. of the respective widths L2 and L3, and therefore considerably less than the sum of the width L1 of the scanning device 16 and of that L3 of the printer 12.

For instance, on the basis of the numerical data given earlier, in the built-up configuration, the all-out transverse clearance L4 assumed by the terminal unit 10, defined by the sum of L2 and L3, is therefore equal to 200+220=420 mm.

Figure 5:
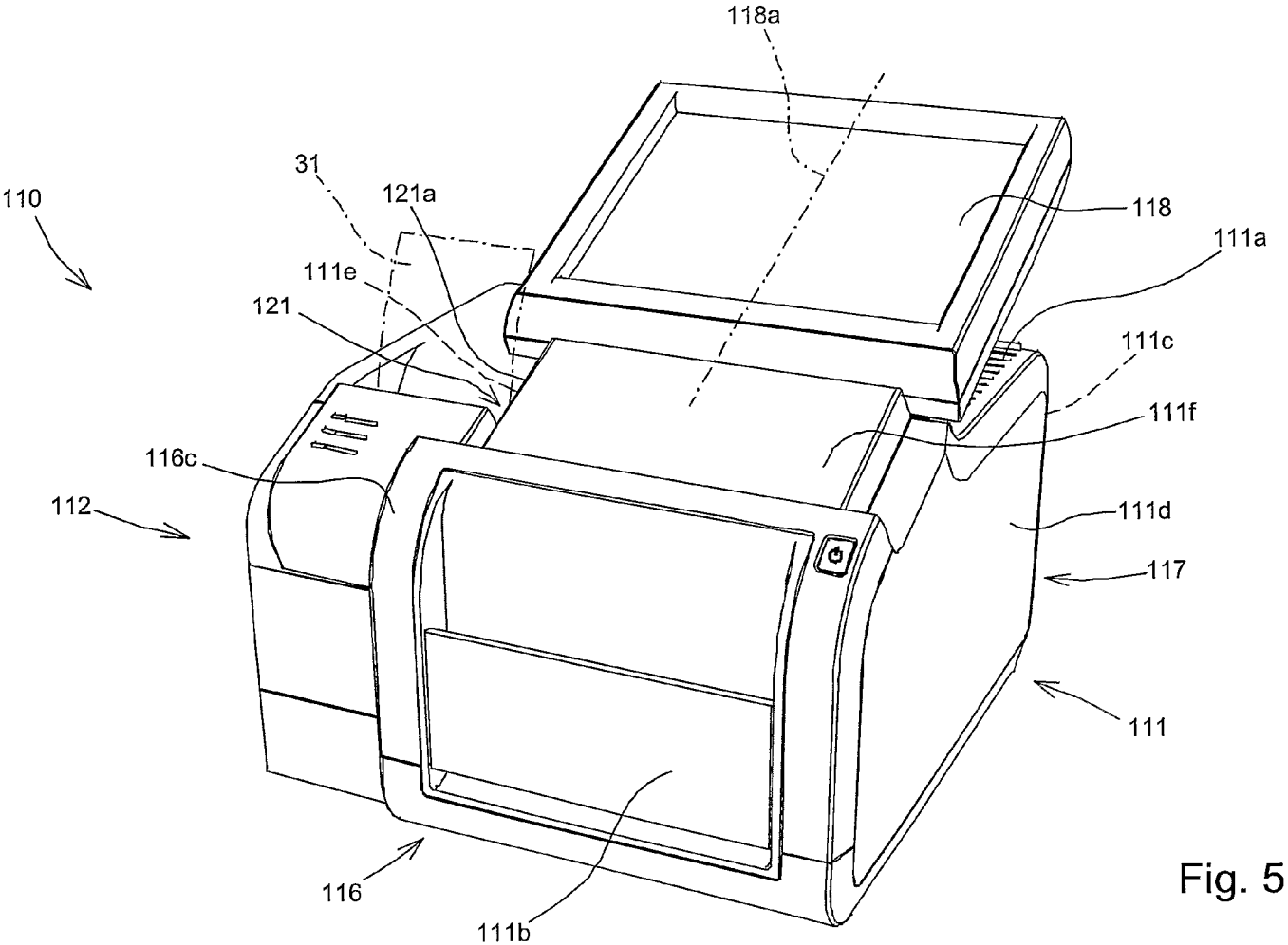
FIG. 5 is a perspective view of another embodiment of the terminal unit of FIG. 1.

FIG. 5 represents another embodiment, indicated with the numeral 110, of the terminal unit of the invention, in which for clarity's sake the parts corresponding to those of the terminal unit 10 are indicated with the same numerical references plus 100.

The terminal unit 110 is formed a base unit 111, and a printer 112 of known type, in particular of the type suitable for being fed with a paper ribbon 31 and for issuing printed receipts.

The base unit 111 in turn includes a scanning device 116 incorporated in the base unit 111 in a front area 111*b*, a main body 117 arranged behind the scanning device 116, and a display screen 118, fulcrum-mounted on an upper area 111*a* of the base unit 111 and having the respective centre line 118*a* substantially aligned with that of the scanning device 116, as in the terminal unit 10.

The terminal unit 110 also possesses, just like the terminal unit 10, a seat 121, which is defined by a lateral protruding portion 116*c* of the scanning device 116 and by a side 111*e* of the base unit 111 and which is intended for housing the printer 112 arranged side by side against the base unit 111 and behind the scanning device 116.

In particular, the terminal unit 110 differs from the terminal unit 10 due to the fact that the display screen 118 and the scanning device 116 are arranged apart from one another in the base unit 111, so as to define a portion 111*f* of the base unit 111 that separates them, and also due to the fact that this portion 111*f* between the display screen 118 and the scanning device 116 is configured in such a way as to define a recess 121*a*, adjacent to the seat 121 that houses the printing unit 112, said recess 121*a* being suitable for receiving the paper ribbon 31, and accordingly the relative receipt when it is issued by the printer 112.

In this configuration of the terminal unit of the invention, the portion 111*f* of the base unit 111 can removably support or even integrate a keyboard, of known type and not depicted in any of the drawings, in order to increase the features of the terminal unit.

The invention claimed is:

1. A terminal unit that comprises:

a base unit having a front side, a rear side, a first lateral side, and a second lateral side, the base unit including a main body defining said rear side and said first and second lateral sides of said base unit, the base unit further including a scanning device defining said front side of said base unit and a display screen, said first and second lateral sides of said base unit defining a main body width, and said scanning device defining a scanning device width between a first side wall and a second side wall; and a printing unit distinct from the base unit, and defining a printing unit width;

wherein:

said scanning device width and a width of said display screen are greater than said main body width, the first side wall of said scanning device and said display screen being arranged so as to protrude laterally with respect to said first lateral side of said main body;

said scanning device being arranged to shape a scanning device rear side, the second side wall of the scanning device being aligned with said second lateral side of said base unit;

said display screen being fulcrum-mounted, on said base unit, in an area immediately above said scanning device;

said first lateral side of said main body and said scanning device rear side jointly form a L -shaped recessed seat adapted to removably house said printing unit in a position lateral of said first lateral side and partially behind said scanning device, said printing unit being user accessible from said front side of said base unit when in use in said L-shaped recessed seat; and said terminal unit defines a terminal unit width that is less than the sum of said scanning device width and said printing unit width.

2. A terminal unit according to claim 1, wherein said scanning device includes an entrance section adapted to receive a document to be read, and an exit section adapted to eject the document.

3. A terminal unit according to claim 1, wherein said printing unit is adapted to issue to the outside a printed slip of paper.

4. A terminal unit according to claim 1, wherein said base unit defines a top surface that includes the display screen, said display screen defining a centre plane, wherein said scanning device defines a centre plane substantially in line with said centre plane of said display screen, said base unit defining a second center plane different from the centre plane defined by the scanning device and by the display screen.

5. A terminal unit according to claim 4, wherein said display screen and said scanning device are arranged apart from one another in said base unit, and wherein said base unit defines a recess between said display screen and said scanning unit and adjacent to said seat for housing said printing unit, said recess being adapted to receive a slip of paper issued by said printing unit.

6. Terminal unit according to claim 1, wherein said scanning device is adapted to receive and read sheets of A4 format.

7. Terminal unit according to claim 6, wherein said main body width is approximately 220 mm, and said printer width is approximately 200 mm, so that said terminal unit width, in an assembled configuration with said base unit and said printing unit arranged side by side, one against the other, is approximately 420 mm.

8. Terminal unit according to claim 1, wherein said display screen is of the 12" type.

9. A terminal unit according to claim 1, wherein said display screen is arranged to substantially shape a top surface of said terminal unit.

* * * * *